US005686160A

United States Patent [19]

Yamada et al.

[11] Patent Number: 5,686,160

[45] Date of Patent: Nov. 11, 1997

[54] FLUOROPOLYMER COATED ARTICLE HAVING INLAID PATTERN

[75] Inventors: Katsuya Yamada; Masahiro Morita, both of Osaka, Japan

[73] Assignee: Sumitomo Electric Industries, Ltd., Japan

[21] Appl. No.: 533,417

[22] Filed: Sep. 25, 1995

Related U.S. Application Data

[63] Continuation of Ser. No. 380,468, Jan. 30, 1995, abandoned, which is a continuation of Ser. No. 222,551, Apr. 4, 1994, abandoned, which is a continuation of Ser. No. 667,692, Mar. 11, 1991, abandoned.

[30] Foreign Application Priority Data

Mar. 9, 1990 [JP] Japan ..... 2-58949
Jan. 30, 1991 [JP] Japan ..... 3-9732

[51] Int. Cl.[6] ..... B44C 1/26

[52] U.S. Cl. ..... 428/67; 220/912; 428/34.1; 428/167; 428/172; 428/173; 428/187; 428/192; 428/207; 428/324; 428/328; 428/408; 428/421; 428/422

[58] Field of Search ..... 478/67, 187, 192, 478/324, 328, 422, 421, 34.1, 167, 172, 173, 207, 408; 220/912; D7/354

[56] References Cited

U.S. PATENT DOCUMENTS 3,423,279 1/1969 Grover ..... 428/422

*Primary Examiner*—Nasser Ahmad
*Attorney, Agent, or Firm*—Pennie & Edmonds LLP

[57] ABSTRACT

A fluoropolymer coated article includes a fluoropolymer coating layer formed on a surface of a substrate. The fluoropolymer coated article has a concave formed on a fluoropolymer coating layer side surface of the fluoropolymer coated article. The concave is inlaid with a fluoropolymer composition containing a pigment.

This fluoropolymer coated article can be used in for example an inner pan of a rice cooker, in order to indicate a scale, marks or letters which is very easy to see and which is excellent in durability and in corrosion resistance, while maintaining nonadhesiveness of the fluoropolymer coating.

14 Claims, 2 Drawing Sheets

FLUOROPOLYMER COATED ARTICLE HAVING INLAID PATTERN

This is a continuation of application Ser. No. 08/380,468, filed Jan. 30, 1995, now abandoneded which is a FWC of application Ser. No. 08/222,551, filed Apr. 4, 1994, now abandoned which is a FWC of application Ser. No. 07/667, 692, filed Mar. 11, 1991 now abandoned.

BACKGROUND OF THE INVENTION

1. Field of the Invention

The present invention relates to a fluoropolymer coated article having an inlaid pattern, and more specifically to a fluoropolymer coated article having an inlaid pattern such as scales, latters, and decorative patterns, which are formed of a pigment-containing fluoropolymer inlaid into a concave formed on a surface of the fluoropolymer coated article.

The present invention is effectively applicable in forming, on an inner pan (in which rice is boiled) of an electric rice cooker or on another, an easy-to-see or legible indication such as a scale, a pattern and letters, which is excellent in corrosion resistance and in the property of bonding to a substrate and a fluoropolymer coating layer, and which does not decrease an inherent nonadhesiveness of the fluoropolymer itself and hardly sustains damages such as friction and peeling-off when cooking and washing are made.

2. Description of Related Art

Since fluoropolymer is nonadhesive, it is difficult to print a scale, a letter and/or a decorative pattern by use of a printing ink, on a fluoropolymer coated article, for example, on a fluoropolymer coating layer surface of a fluoropolymer coated metal plate such as a fluoropolymer coated aluminum plate.

In the prior art, therefore, when it is necessary to provide a scale, letters and/or a decorative pattern on a fluoropolymer coating layer, an embossing process has been used. Namely, an embossing die is pressed onto a surface of the fluoropolymer coated article by using a press machine, so that a convex or concave pattern is mechanically formed on the fluoropolymer coating layer and/or the metal plate substrate.

On the other hand, even if a scale, letters and/or a decorative pattern could have been printed by use of a printing ink, the nonadhesiveness has decreased in a printed portion. Therefore, when the printed pattern is provided for example on an inner pan of a rice cooker, boiled rice is adhered on the printed portion. Namely, this approach is not preferred. As a result, indications on the inner pans of the rice cooker have been all embossed.

However, the embossing has been disadvantageous in the following points:

Firstly, since an embossed portion of a substrate is greatly deformed with a large curvature, a fluoropolymer coating layer on the substrate is correspondingly expanded. In this process, there is a tendency that a peeling-off occurs at a boundary between the fluoropolymer coating layer and the substrate, and pin holes (very fine defects) and cracks occur in the fluoropolymer coating layer. In the case of the inner pan of the rice cooker, water and rice soup permeate through these pin holes and the cracks, so that the substrate is corroded, and the fluoropolymer coating layer is peeled off and becomes discolored.

Secondly, a convex-concave pattern obtained by the embossing gives an indication only by a shading produced by the convex and concave. Therefore, it is not so easy to see the pattern. Lately, the electric rice cooker has many functions, and the number of indications typified by a water level scale provided on the inner pan has correspondingly increased. For example, various scales including a normal rice cooking water level scale, a rice-cake rice cooking water level scale, and a rice gruel cooking water level scale have been embossed at several locations. As a result, a problem that it is not so easy to see the scales and their associated letters has become significant.

SUMMARY OF THE INVENTION

Accordingly, it is an object of the present invention to make it possible to provide, on a fluoropolymer coated article having a nonadhesive fluoropolymer coating layer, a pattern such as a scale or letters, which has overcome the above mentioned defect of the conventional one.

The above and other objects of the present invention are achieved in accordance with the present invention by a fluoropolymer coated article comprising a substrate and a fluoropolymer coating layer formed on a surface of the substrate, the fluoropolymer coated article having a concave portion which is formed on a fluoropolymer coating layer side surface thereof and which is inlaid with a fluoropolymer composition containing a pigment.

According to another aspect of the present invention, there is provided a method of manufacturing a fluoropolymer coated article having an inlaid pattern, comprising the steps of preparing a fluoropolymer coated article composed of a substrate and a fluoropolymer coating layer formed on a surface of the substrate, the fluoropolymer coated article having a concave portion which is formed on a fluoropolymer coating layer side surface thereof, applying a fluoropolymer composition containing a pigment into the concave portion, and heating and sintering a whole of the fluoropolymer coated article at a temperature not less than a melting point of the fluoropolymer.

Formation of the fluoropolymer coating layer can be performed by using any known method. A general approach is to deposit fluoropolymer on the substrate and to sinter the fluoropolymer deposited substrate. In this process, it is preferred that if desired, a surface of the substrate is roughened by means of sand blasting, and then, a primer is deposited on the roughened surface of the substrate.

The fluoropolymer composition containing the pigment is basically composed of pigment and fluoropolymer powder, and may be added with a dispersion medium for the fluoropolymer podwer, if desired. Any known fluoropolymer can be used. Polytetrafluoroethylene (PTFE), tetrafluoroethylene-hexafluoropropylene copolymer (FEP), tetrafluoroethylene-perfluoroalkylvinylether copolymer (PFA), ethylene-tetrafluoroethylene copolymer (ETFE), polychlorotrifluoroethylene (PCTFE), and ethylene-chlorotrifluoroethylene copolymer (ECTFE) can be exemplified.

The composition including the fluoropolymer powder and the dispersion medium can be realized in the form of an aqueous dispersion liquid of fluoropolymer obtained by emulsion polymerization, in the form of a dispersion liquid obtained by dispersing the fluoropolymer powder in an aqueous medium, in the form of an organosol of fluoropolymer, or in the form of an aqueous emulsion of the organosol.

The pigment can be either any metal powder or any inorganic pigment such as metal oxide powder and mica powder. However, titanium oxide, carbon black, pigment coated mica, and their mixture are preferred, since these material give good appearance and impression with no remarkable loss of the nonadhesiveness and the corrosion resistance of the fluoropolymer itself. If desired, any colorant such as organic pigment and dye can be added.

The substrate is preferably formed of aluminum. However, any material can be used if a concave can be formed.

The concave can be in any shape which can give a water level scale or instruction letters or patterns The concave can be formed by any machining method, for example, an embossing using a press machine, a laser etching or a mechanical cutting. In addition, the concave is preferably formed to have a depth reaching at least a portion of the surface of the substrate. But, the concave may be formed only in the fluoropolymer coating layer. The only important matter is that the concave is recessed from a surface of the fluoropolymer coating layer. The concave can be formed before the fluoropolymer coating layer is formed on the substrate (after-coating process) or may be formed after the fluoropolymer coating layer is formed on the substrate (pre-coating process).

Application of the pigment-containing fluoropolymer composition to the concave can be carried out by means of any known method, for example, an ink-jet method, a spray method, a screen printing method or a letterpress printing.

After the pigment-containing fluoropolymer composition is applied to or filled into the concave, the whole of the fluoropolymer coated substrate is heated and sintered at a temperature not less than a melting point of the fluoropolymer. But, the heating can be limited to only the fluoropolymer composition filled concave. The heating can be realized by a hot-air heating, a radiation heating, a heat transfer heating from a periphery of the fluoropolymer composition filled concave, or a laser scanning of the fluoropolymer composition filled concave.

In the present invention, the pigment-containing fluoropolymer composition is not deposited on a flat surface, but is inlaid into the concave. This gives the following advantages:

(1) For example, in the case that the fluoropolymer coated article having the inlaid pattern is realized in the form of a cookware, the inlaid pigment-containing fluoropolymer composition hardly sustains friction in the case of cooking and in the case of washing, and therefore, it will be subjected to almost no damage such as wearing and peeling-off. As a result, the indication hardly disappears, and accordingly, the indication having high durability can be realized.

(2) Since the color of the inlaid fluoropolymer composition is added to the shading of the concave in which the fluoropolymer composition is inlaid, the indication becomes more easy-to-see in comparison with the conventional embossed indication, and in comparison with an indication formed of the pigment-containing fluoropolymer composition deposited on the flat surface (3) The pin holes and the cracks generated at the time of embossing are repaired by the inlaid fluoropolymer composition. This secondary effect remarkably improves the corrosion resistance.

Furthermore, since the inlaid resin composition is formed of the fluoropolymer composition, the following advantages can be obtained:

(4) The indication portion has an excellent nonadhesiveness since the fluoropolymer composition is nonadhesive.

(5) Since both of the coating layer and the inlaid composition include the same fluoropolymer as a main component, the coating layer and the inlaid composition are fusion-bonded to each other, so that the coating layer and the inlaid composition become integral with each other under a large bonding force.

As seen from the above, the fluoropolymer coated article having the inlaid pattern in accordance with the present invention makes it possible to form, on an inner pan of an electric rice cooker or on others, an easy-to-see or legible indication such as a scale, a pattern and letters, which is excellent in corrosion resistance, in durability and in the property of bonding to a substrate and a fluoropolymer coating layer, and which does not decrease an inherent nonadhesiveness of the fluoropolymer itself and hardly sustains damages such as friction and peeling-off in the way of cooking and in the way of washing.

Therefore, the fluoropolymer coated article having the inlaid pattern in accordance with the present invention can be effectively applied in case of adding a scale indication, a legend and/or a pattern on various kitchenwares.

In addition, the fluoropolymer coated article having the inlaid pattern in accordance with the present invention is not limited in shape. Therefore, the fluoropolymer coated article in accordance with the present invention can be realized not only, in the form of a finished article such as the inner pan of the rice cooker, but also in the form of a material or stock such as a fluoropolymer coated aluminum plate.

The above and other objects, features and advantages of the present invention will be apparent from the following description of preferred embodiments of the invention with reference to the accompanying drawings.

DESCRIPTION OF THE PREFERRED EMBODIMENTS

Figure 1:
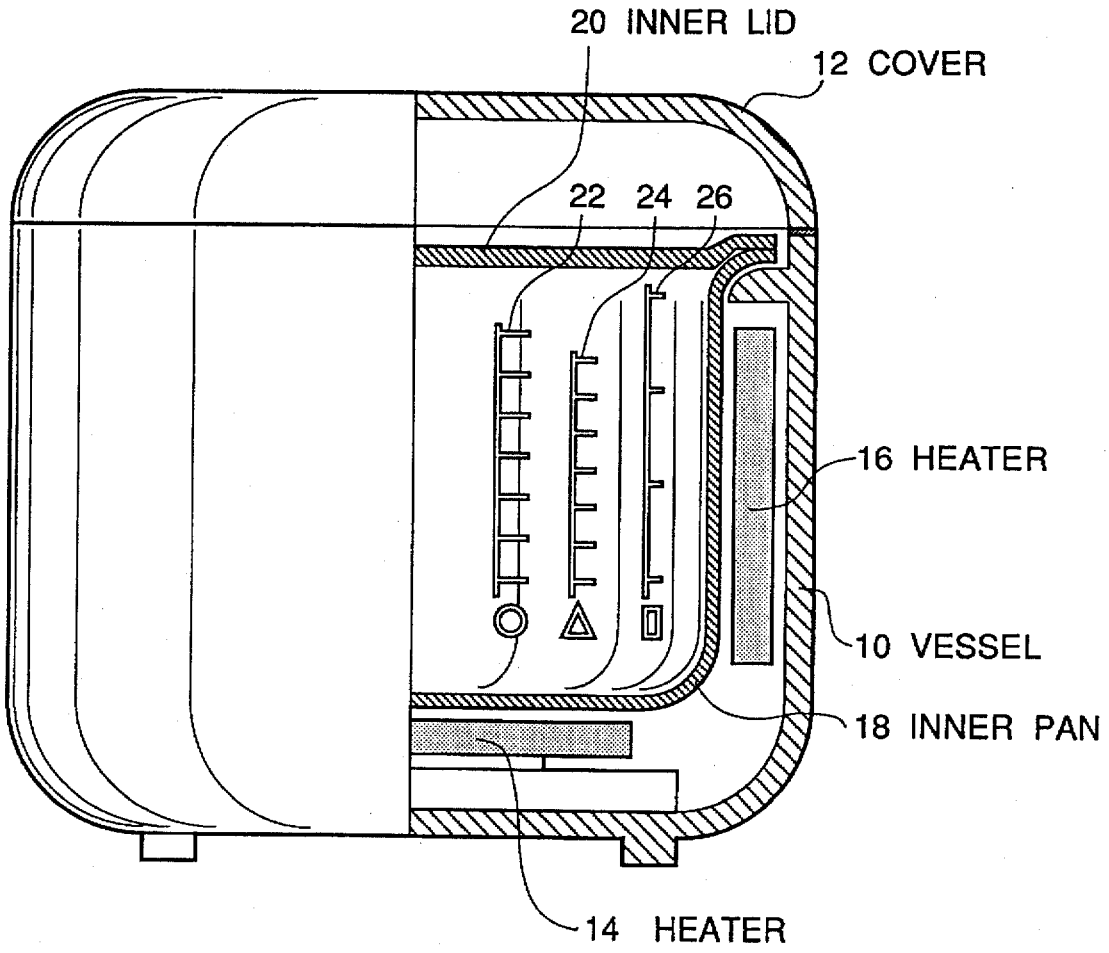
FIG. 1 is a partially broken diagrammatic plan view of an electric rice cooker which can use the fluoropolymer coated article in accordance with the present invention.

Referring to FIG. 1, there is shown a partially broken diagrammatic plan view of an electric rice cooker which can use the fluoropolymer coated article in accordance with the present invention. The shown rice cooker has a vessel 10 and a cover 12, and electric heaters 14 and 16 are located on a bottom and an inner side wall of the vessel 10, respectively. On the bottom heater 14, an inner pan 18 is placed, which is formed of for example aluminum. This inner pan 18 can be covered with an inner lid 20. An inner wall of the inner pan 18 and a rear surface of the inner lid 20 are coated with fluoropolymer. In addition, the inner pan 18 is provided with a normal rice cooking water level scale 22, a rice-cake rice cooking water level scale 24, and a rice gruel cooking water level scale 26.

The present invention is effectively applied in forming the normal rice cooking water level scale 22, the rice-cake rice cooking water level scale 24, the rice gruel cooking water level scale 26, and others, on the fluoropolymer coating layer which is coated on the inner wall of the inner pan 18.

COMPARATIVE EXAMPLE 1 (pre-coating process)

Inner Pan of an Electric Rice Cooker Having a Water Level Scale Formed in Accordance with a Conventional Method A flat aluminum plate was surface-roughened by etching so that a fluoropolymer coating can be physically and tightly deposited on a surface of the aluminum plate. Then, a fluoropolymer composition including 60 weight % of PTFE powder, 6 weight % of surfactant (surface-active agent), and 34 weight % of water was coated on a whole of the roughened surface of the flat aluminum plate. The aluminum plate thus obtained was heated in a sintering furnace, so that a fluoropolymer coated aluminum plate was obtained.

The fluoropolymer coated aluminum plate thus obtained was shaped by use of a press machine, so that an inner pan of the electric rice cooker is formed. Thereafter, an inner wall of the inner pan thus formed was embossed so that a concave water level scale is formed.

EMBODIMENT 1 (pre-coating process)

Similarly to the COMPARATIVE EXAMPLE 1, a fluoropolymer composition including 60 weight % of PTFE powder, 6 weight % of surfactant, and 34 weight % of water was coated on a whole of a toughened surface of a flat aluminum plate. The aluminum plate thus obtained was heated in a sintering furnace, so that a fluoropolymer coated aluminum plate was obtained. The fluoropolymer coated aluminum plate thus obtained was shaped by use of a press machine, similarly to the COMPARATIVE EXAMPLE 1, so that an inner pan of the electric rice cooker was formed. Then, an inner wall of the inner pan thus formed was embossed so that a concave water level scale was formed.

In this embodiment, a stainless mask perforated in the same pattern as the embossed pattern formed on the inner wall of the inner pan was closely laid on the inner wall of the inner pan in such a manner that the perforated pattern of the stainless mask is in matching with the embossed pattern formed on the inner wall of the inner pan. Thereafter, a fluoropolymer composition including 40 weight % of PTFE powder, 2 weight % of titanium oxide (white pigment), 10 weight % of surfactant, and 48 weight % of water was sprayed to fill the embossed pattern formed on the inner wall of the inner pan. Then, the inner pan was dried in a constant temperature bath at 100° C. for 5 minutes, and thereafter, sintered at 420° C. for 2 minutes.

Figure 2:
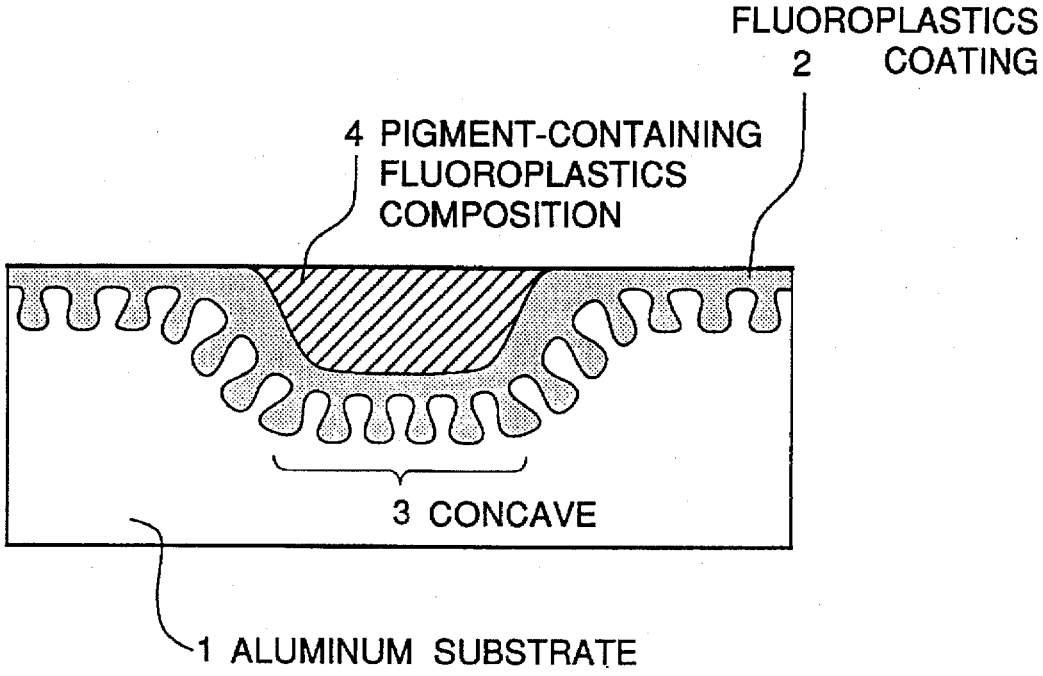
FIG. 2 is a diagrammatic sectional view of one embodiment of the fluoropolymer coated article in accordance with the present invention.
Figure 3:
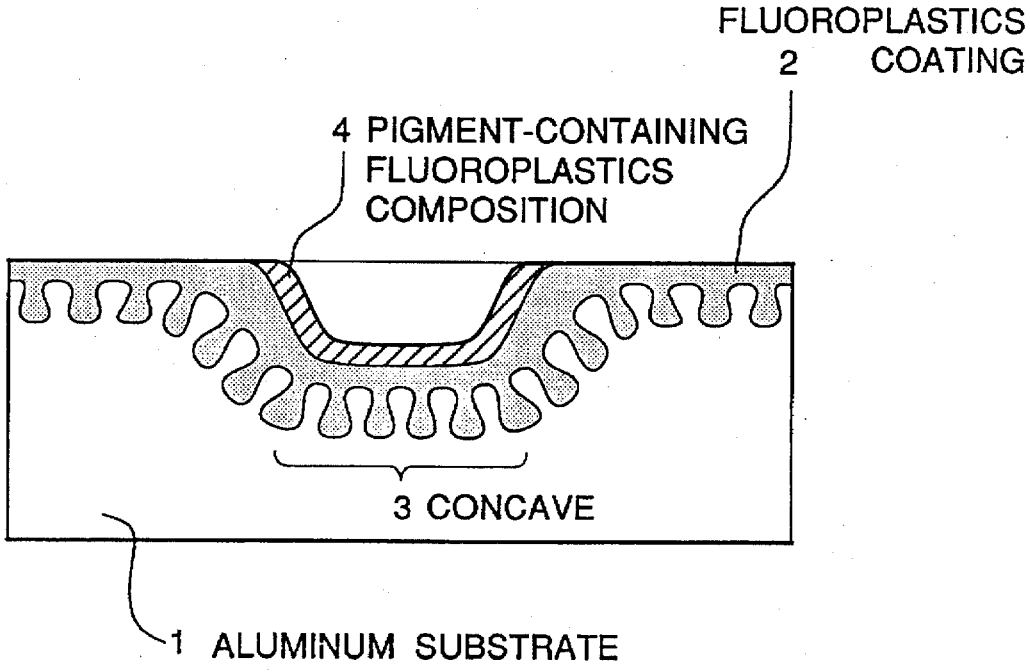
FIG. 3 is a diagrammatic sectional view of another embodiment of the fluoropolymer coated article in accordance with the present invention.

Thus, the inner pan having the scale indication formed of a white fluoropolymer composition 4 inlaid in a concave 3 as shown in FIG. 2 was obtained. Incidentally, FIG. 2 shows a sectional view of only the scale indication portion of the inner pan. Reference Numeral 1 designates an aluminum plate substrate which forms the inner pan, and Reference Numeral 1 indicates a fluoropolymer coating layer formed on the aluminum plate substrate 1, so that a shallow concave remains.

In place of completely filling up the concave 3 as shown in FIG. 2, an inner surface of the concave 3 can be merely coated with the fluoropolymer composition 4.

EMBODIMENT 2 (pre-coating process)

The same process as that of the EMBODIMENT 1 was performed, except that the fluoropolymer composition inlaid in the concave of the embossed pattern includes 40 weight % of PTFE powder, 2 weight % of pigment-coated mica ("Iriodin 524" available from Merk, Germany), 10 weight % of surfactant, and 48 weight % of water.

As a result, the inner pan having the scale indication formed of a red metallic fluoropolymer composition inlaid in a concave was obtained.

COMPARATIVE EXAMPLE 2 (after-coating process)

A fluoropolymer composition including 60 weight % of PTFE powder, 6 weight % of surfactant, and 34 weight % of water was coated on a whole of a roughened surface of a flat aluminum plate. The aluminum plate thus obtained was heated in a sintering furnace, so that a fluoropolymer coated aluminum plate was obtained. The fluoropolymer coated aluminum plate thus obtained was shaped by use of a press machine, so that an inner pan of the electric rice cooker was formed.

Then, the stainless mask used in the EMBODIMENT 1 was closely laid on the smooth inner wall of the inner pan, and a fluoropolymer composition including 40 weight % of PTFE powder, 2 weight % of titanium oxide, 10 weight % of surfactant, and 48 weight % of water was sprayed toward the mask laid on the smooth inner wall of the inner pan. Thereafter, the inner pan was dried in a constant temperature bath at 100° C. for 5 minutes, and thereafter, sintered at 420° C. for 2 minutes. Thus, the inner pan having the white water level scale healed on the smooth inner wall of the inner pan was obtained.

EMBODIMENT 3 (after-coating process)

First, an aluminum plate was pressed to the same shape as the inner pan of the EMBODIMENT 1, so that an uncoated aluminum inner pan was formed. A water level scale having a concave pattern having a depth of 0.3 mm and a width of 0.6 mm was embossed onto an inner surface of the inner pan thus obtained. Then, the inner surface of the inner pan was roughened by sand blasting, and coated with a fluoropolymer primer. After it was dried, a fluoropolymer top coating layer was deposited on the inner wall of the inner pan. Thereafter, it was dried again, and the inner pan was sintered at 380° C. for 30 minutes. The fluoropolyrner coating thus obtained including the primer and the top coating layer had a thickness of 30 μm.

In the concave of the water level scale of the fluoropolymer coated article thus obtained, a white fluoropolymer composition was inlaid in the same manner as that of the EMBODIMENT 1. Thus, the inner pan has been finished.

The following test were performed for the inner pans obtained in the above mentioned EMBODIMENTs 1, 2 and 3 and COMPARATIVE EXAMPLES 1 and 2.

(a) rice cooking test of 100 times (b) rice washing test of 500 times (c) appearance evaluation The result is as follows:

(1) EMBODIMENT 1

(the substrate was concave-embossed, and the fluoropolymer composition used for the scale indication including the titanium oxide pigment was inlaid in the embossed concave)

(a) rice cooking test of 100 times: good (no change)

(b) rice washing test of 500 times: good (the indication did not disappear)

(c) appearance evaluation: good (the indication was white and very easy to see)

(d) total evaluation: excellent (2) EMBODIMENT 2

(the substrate was concave-embossed, and the fluoropolymer composition used for the scale indication including the pigment coated mica was inlaid in the embossed concave)

(a) rice cooking test of 100 times: good (no change)

(b) flee washing test of 500 times: good (the indication did not disappear)

(c) appearance evaluation: good (the indication was red and very easy to see)

(d) total evaluation: excellent (3) EMBODIMENT 3

(the substrate was concave-embossed, and the fluoropolymer composition used for the scale indication includes the titanium oxide pigment was inlaid in the embossed concave)

(a) rice cooking test of 100 times: good (b) rice washing test of 500 times: good (c) appearance evaluation: good (d) total evaluation: excellent (4) COMPARATIVE EXAMPLE 1

(the substrate was embossed, and the fluoropolymer composition was not inlaid in the embossed concave)

(a) rice cooking test of 100 times: bad (the embossed portion was corroded)

(b) rice washing test of 500 times: good (no change)

(c) appearance evaluation: bad (the indication was difficult to see because of only the shading of the embossed concave)

(d) total evaluation: bad (5) COMPARATIVE EXAMPLE 2

(the substrate was not embossed, and the fluoropolymer composition used for the scale indication including the titanium oxide pigment was deposited)

(a) rice cooking test of 100 times: good (no change)

(b) rice washing test of 500 times: bad (the indication partially disappeared)

(c) appearance evaluation: good (the indication was white and very easy to see)

(d) total evaluation: not so good

As seen from the above, it was confirmed that the inner pan obtained in the EMBODIMENTs 1 to 3 are very excellent in the total evaluation including the durability of the water level scale and the easy-to-see property.

The invention has thus been shown and described with reference to the specific embodiments. However, it should be noted that the present invention is in no way limited to the details of the illustrated structures but changes and modifications may be made within the scope of the appended claims.

We claim:

1. A fluoropolymer coated article comprising a substrate having at least one surface, a fluoropolymer coating formed to completely cover said at least one surface of the substrate, and a concave portion formed on a fluoropolymer coating side surface of the fluoropolymer coated article and recessed from said fluoropolymer coating, said concave portion being inlaid with a composition consisting essentially of a fluoropolymer and a pigment, said fluoropolymer coating and said fluoropolymer contained in said composition being fusion-bonded to each other so as to be integral with each other.

2. A fluoropolymer coated article claimed in claim 1 wherein said fluoropolymer composition is mainly composed of a fluoropolymer selected from the group consisting polytetrafluoroethylene, tetrafluoroethylene-hexafluoropropylene copolymer, tetrafluoroethylene-perfluoroalkylvinylether copolymer, ethylene-tetrafluoroethylene copolymer, polychlorotrifluoroethylene, and ethylene-chlorotrifluoroethylene copolymer.

3. A fluoropolymer coated article claimed in claim 1 wherein said pigment is a metal powder or an inorganic pigment.

4. A fluoropolymer coated article claimed in claim 3 wherein said pigment is a material selected from the group consisting of titanium oxide, carbon black, pigment coated mica, and their mixture.

5. A fluoropolymer coated article claimed in claim 1 wherein said substrate is formed of metal.

6. A fluoropolymer coated article claimed in claim 1 wherein said concave portion is in the form of a scale, a letter or a pattern.

7. A fluoropolymer coated article claimed in claim 1 wherein said wherein said concave portion is partially inlaid with said fluoropolymer composition containing the pigment.

8. A fluoropolymer coated article comprising a substrate having at least one surface, a fluoropolymer coating formed to completely cover said at least one surface of the substrate, and an indicator formed on said fluoropolymer coating, said fluoropolymer coating having a concave portion recessed from said fluoropolymer coating, said indicator being formed of a composition consisting essentially of a pigment and a fluoropolymer and being inlaid into said concave portion, said fluoropolymer coating and said fluoropolymer contained in said composition being fusion-bonded to each other so as to be integral with each other.

9. A fluoropolymer coated article claimed in claim 8 wherein said fluoropolymer composition is mainly composed of a fluoropolymer selected from the group consisting polytetrafluoroethylene, tetrafluoroethylene-hexafluoropropylene copolymer, tetrafluoroethylene-perfluoroalkylvinylether copolymer, ethylene-tetrafluoroethylene copolymer, polychloro-trifluoroethylene, and ethylenechlorotrifluoro-ethylene copolymer.

10. A fluoropolymer coated article claimed in claim 8 wherein said pigment is a metal powder or an inorganic pigment.

11. A fluoropolymer coated article claimed in claim 10 wherein said pigment is a material selected from the group consisting of titanium oxide, carbon black, pigment coated mica, and their mixture.

12. A fluoropolymer coated article claimed in claim 8 wherein said substrate is formed of metal.

13. A fluoropolymer coated article claimed in claim 8 wherein said concave portion is in the form of a scale, a letter or a pattern.

14. An inner pan of an electric rice cooker comprising a fluoropolymer coating formed to completely cover an inner wall of the inner pan, and an indicator formed on said inner wall of the inner pan, said inner wall of said inner pan having a concave portion which is formed on said inner wall of said inner pan and which is covered with said fluoropolymer coating, said indicator being formed of a composition essentially consisting of a pigment and a fluoropolymer and being inlaid into said concave portion, said fluoropolymer coating and said fluoropolymer contained in said composition being fusion-bonded to each other so as to be integral with each other.

* * * * *